United States Patent [19]

Wolf

[11] 4,229,016

[45] Oct. 21, 1980

[54] SAFETY SKI POLE

[76] Inventor: David Wolf, 67 Brackett Rd., Newton, Mass. 02159

[21] Appl. No.: 957,980

[22] Filed: Nov. 6, 1978

[51] Int. Cl.[3] ..... A63C 11/22

[52] U.S. Cl. ..... 280/821; 224/52

[58] Field of Search ..... 280/11.37 B, 11.37 D, 280/11.37 H, 11.37 L; 224/52, 55

[56] References Cited

U.S. PATENT DOCUMENTS 3,378,273 4/1968 Lewis et al. ..... 280/11.37 H

FOREIGN PATENT DOCUMENTS 2157494 5/1973 Fed. Rep. of Germany ... 280/11.37 D 2518783 11/1976 Fed. Rep. of Germany .... 280/11.37 L 562041 5/1975 Switzerland ..... 280/11.37 H

*Primary Examiner*—John J. Love

*Assistant Examiner*—Michael Mar

*Attorney, Agent, or Firm*—Wolf, Greenfield & Sacks

[57] ABSTRACT

A ski pole formed with a separate handle and shaft. The handle and shaft are held in normal longitudinal alignment for normal use. Means are provided to permit the handle to be moved angularly with respect to the shaft when forces above a preselected minimum are applied to the shaft and handle in different directions. The ski pole thus bends at the handle when a skier holding the ski pole has forces applied to his hand above a preselected minimum. Means are also provided for adjusting the minimum force required to permit release of the handle from longitudinal alignment with the shaft.

3 Claims, 5 Drawing Figures

SAFETY SKI POLE

BACKGROUND OF INVENTION

The conventional ski pole used for alpine or cross-country skiing consists essentially of an elongated shaft having a point and basket at one end and a handle at the other. The handle of the pole is normally integrally formed with the shaft of a single piece of metal, although frequently the handle end of this single piece of shaft is covered with a finger grip. Because the pole is rigid along the entire length, skiers are frequently injured when the pointed end of the ski pole is engaged and rigidly secured in the snow while the skier is moving. This type of accident will happen, for example, when a skier is making a quick stop or turn. The skier jams the pole into the snow and occasionally will rigidly engage the pointed tip of the pole in the snow against a rock or underneath his ski while turning or stopping. At the same time, the forward movement of the skier causes his hand to move in the direction of skiing while the pole remains implanted in the snow. When this occurs, the skier's thumb is jammed against the handle end of the pole frequently bending it back and causing serious and sometimes permanent injury to the thumb joint.

Ski pole manufacturers have attempted to avoid this type of injury by providing handles with break-away straps. The theory of operation in providing such break-away straps is that the strap will release when unusual forces are applied to the hand of the skier, thus, presumably, avoiding the type of injury described above. Unfortunately, break-away straps which are frequently made of a piece of plastic integrally molded with the hand grip and appropriately split to permit ease in removal do not perform and function as desired. When a skier's hand is forced against the handle of a ski pole, the type of injury described above will occur even if there were no break-away strap, or for that matter, any strap on the pole. In short, it is the skier's hand rigidly holding the handle of the ski pole which is the source of the injury rather than a strap. These break-away straps do perform some function, but the function they perform is normally to avoid injuries to the wrist which occasionally occur if the ski pole is rigidly attached to the skier's hand.

It is therefore an object of the present invention to provide an improved ski pole designed to minimize the likelihood of injury to skiers' thumbs when ski poles become jammed in the snow during use. A further object of the present invention is to provide an improved ski pole having an articulatable handle normally held in longitudinal alignment with the ski pole shaft during use, but which shaft and handle may be moved angularly with respect to one another upon the application of forces on the handle and shaft in different directions of a minimum magnitude.

A further object of the present invention is to provide an improved ski pole with a handle which can be moved relative to the shaft, that is inexpensive in design, easy to assemble and repair and inexpensive to make.

A further object of the present invention is to provide an improved ski pole construction having a handle that is designed to be moved angularly to the shaft upon application of forces on the handle and shaft in different directions and in which the minimum force required to permit such movement may be selectively adjusted.

BRIEF DESCRIPTION OF DRAWINGS

The foregoing objects and advantages of the present invention will be more clearly understood when considered in conjunction with the accompanying drawings in which.

DETAILED DESCRIPTION OF INVENTION

Figure 1:
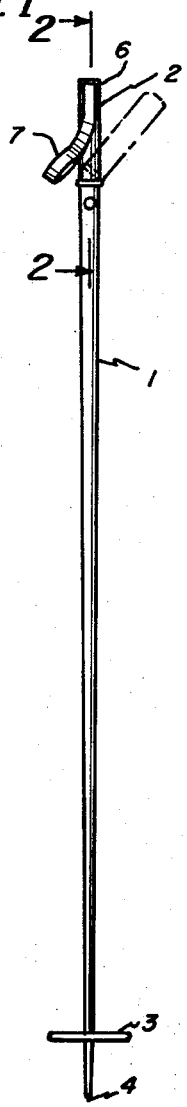
FIG. 1 is a elevational view of a ski pole embodying a preferred form of my invention.

Referring to FIG. 1, there is illustrated a ski pole embodying a preferred form of my invention in which the ski pole comprises a shaft 1 and a handle 2 longitudinally aligned with and secured by means hereafter described to the shaft 1. A basket 3 of conventional design is mounted on the end of the shaft opposite the handle by conventional means. In addition, the basket end of the shaft is provided with a pointed tip 4 of conventional design. The tip 4 and basket 3 are designed to be engaged in the snow when the ski pole is in use. A hand grip 6 with a safety strap 7 may be formed over the handle 2. The hand grip and safety strap may be of any conventional design including safety release straps which are integrally molded and form part of the hand grip. In the specific embodiment illustrated, the safety strap is a conventional strap normally made of leather or plastic and formed as a loop of sufficient diameter to permit the skier to insert his hand through the strap.

Figure 2:
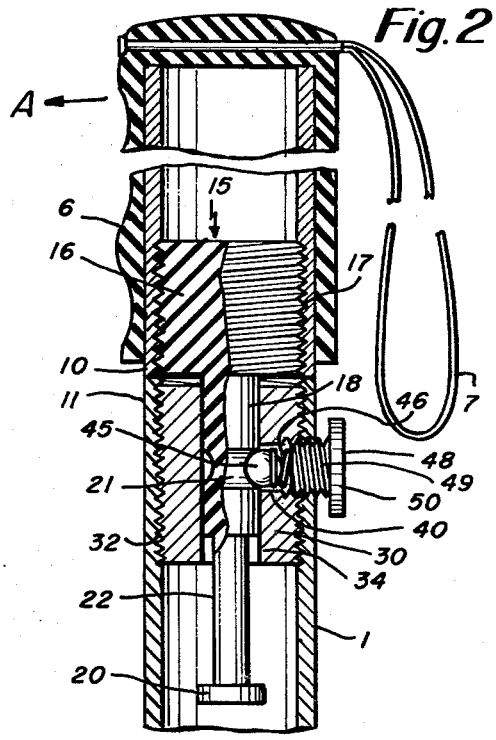
FIG. 2 is a cross-sectional enlarged fragmentary view of the embodiment shown in FIG. 1 taken substantially along the line 2—2 of FIG. 1.

Referring now to FIG. 2, there is illustrated the details of the handle 2. The handle 2 comprises a tubular length of material, preferably steel or aluminum, having one end 10 that is of the same diameter as the adjacent end 11 of the shaft 1. The tubular handle 2 may be cylindrical in shape or may, if desired, be slightly tapered to conform with any taper that may be provided in the shaft 1. The tubular member may be of any desired length, but preferably is at least 4 inches long and is preferably no more than 8 inches long. The length of the tubular handle 2 depends in some part upon the particular size of the ski pole in which the invention is incorporated.

The inner surface of the tubular handle 2 is threaded at end 10.

An interlocking element 15 interengages the handle 2 and the shaft 1. This interlocking element 15 is formed of a flexible plastic or rubber material. The material should be flexible but not deformable and not substantially compressable. Suitable materials include nylon, polyethylene and a relatively dense rubber. The upper end 16 of the interlocking element 15 is cylindrical in shape with the outer cylindrical surface threaded to interengage the threads 17 on the inner surface of the tubular handle. The cylindrical end 16 should have a diameter substantially equal to the inner diameter of the handle 2 at end 10 and a length in the order of ¾ of an inch to 1 inch. Extending axially from the lower end of the cylindrical member 16 is a flexible connector section 18. The flexible connector section 18 may have a length of in the order of 3 to 6 inches and a diameter of in the order of $\frac{3}{4}$ of an inch to $\frac{1}{2}$ of an inch depending upon the type of material used and the flexibility desired. The lower end of the connector 18 is integrally formed with a flange or stop 20. Flange or stop 20 may have a thickness in the order of $\frac{1}{4}$ of an inch and a diameter in the order of $\frac{1}{8}$ of an inch or more greater than the widest diameter of the connector section 18. The connector section 18 is cylindrical in shape except for an annular groove 21 intermediate its length having a semi-circular cross section with a radius equal to the radius of a ball bearing hereafter described. The lower end of the connector section 22 is formed with a reduced diameter over a length of from one half to several inches with the lower end of the reduced diameter in part forming stop 20. The annular groove 21 and the lower section 22 are spaced apart in the order of $\frac{1}{8}$ of an inch to $\frac{1}{2}$ of an inch. The connector section 22 may be formed of a separate piece of material from cylindrical end 16 with the upper end of section 22 threaded and engaging a corresponding threaded hole in the bottom of end 16 (not shown). This arrangement is intended to permit assembly.

A sleeve 30 preferably formed of metal is positioned in the upper end 11 of the shaft 1. This sleeve 30 has an outer diameter substantially equal to the outer diameter of end 11 of shaft 1 and is interengaged with it by threads 32 formed on the outer surface of sleeve 30 that interengage corresponding threads formed on the inner surface on the shaft 1 at its end 11. The sleeve 30 is formed with a longitudinal cylindrical opening having a diameter sufficient to permit a sliding engagement with connector 18 which extends through the opening 34 of the sleeve 30.

A transversely extending cylindrical threaded opening 40 is formed in sleeve 30 in alignment with the groove 21 when the handle and shaft are in a normal aligned position. The opening 40 is also aligned with an opening in the wall of the shaft 1. A ball bearing 45 having a radius substantially equal to the radius of the groove 21 normally engages the groove 21 and simultaneously the opening 40. This ball bearing 21 is held in the position illustrated in FIG. 2 under normal conditions by helical spring 46. An adjusting screw 48 having a threaded shank 40 that extends through the wall of shaft 1 into threaded engagement with the opening 40 is provided with a head 50 external of the wall of the shaft 1. The head 50 may be rotated clockwise or counterclockwise to adjust the tension on the spring 46 thereby, in turn, adjusting the force applied on the ball bearing 45.

In normal use, the handle 2 and shaft 1 are normally positioned in longitudinal alignment as illustrated in FIG. 2. The skier will use the pole in a normal fashion by holding the handle. However, when the ski pole becomes jammed in the snow and for a moment is substantially immovable, the forces applied to the pole by the skier's continuous movement will cause the handle to move angularly with respect to the shaft when a preselected minimum force is exceeded. Thus, for example, if the compression of helical spring 45 is adjusted so that a force in excess of 20 pounds is required to force ball bearing 45 out of groove 21 by compression of spring 46 and if a skier's hand if moving, for example, in the direction of arrow A, while the lower portion of the shank is essentially secured against, applies a net sudden force of 30 pounds in direction of arrow A, the handle will start to articulate at the juncture of ends 10 and 11. This in turn will cause the connector 18 to move upwardly through the opening applying force on the ball bearing 45 thus tending to compress the spring 46. If the force so applied exceeds the force required to compress the spring, the ball bearing will move outwardly and the connector will move upwardly. As soon as the ball bearing has cleared the portion of the connector between the groove 21 and the portion 22, compression on the ball bearing is released, thus permitting free and easy movement of the handle in an articulating movement relative to the shaft.

The skier may simply return the handle and shaft to their initial relative position after the handle has moved relative to the shaft by longitudinally aligning handle and shaft and moving the handle downwardly thus sliding the connector back through the opening until the ball bearing is reset in the groove 21. If necessary, the tension on the spring 46 may be adjusted to permit this resetting with ease.

Figure 3:
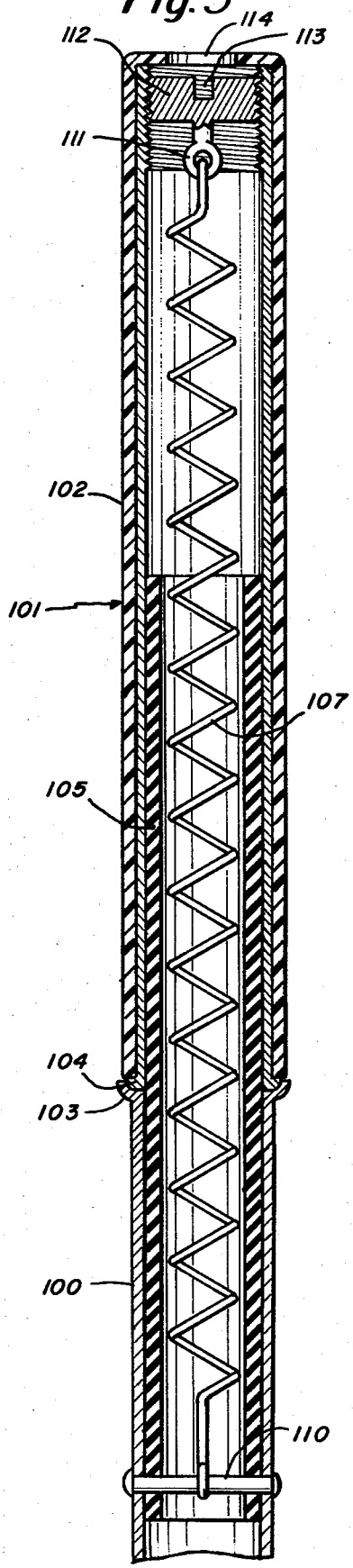
FIG. 3 is a cross-sectional fragmentary view of a modification of my invention taken along a line substantially similar to that of FIG. 2.

Referring now to FIG. 3, there is illustrated a modification of the invention. In this arrangement, the ski pole shaft 100 is longitudinally aligned with a handle section 101. The handle section 101 is covered with a grip 102 of conventional design which may also be provided with a strap. (not shown). A cup-like annular lip 103 at the upper edge of shaft 100 engages an annular flange 104 that is integral with and normally holds the handle section 101 in alignment with the shaft 100. A tubular member or connector section 105 extends longitudinally from the handle section 101 downwardly into the shaft 102. This tubular member 105 is formed of a flexible resilient spring-like element such as rubber or plastic having a rubber-like quality and has a length of about 3" to 6" with half in the shaft 100 and the other half in the handle 101. This member 105 bridges the junction between the section 101 and the shaft 100. Coaxial with and positioned within the shaft 100 and handle section 101 is a helical spring 107. This helical spring is engaged at its lower end by a stop 110. Stop 110 extends through the lower section 100 of the ski pole and is appropriately anchored at its end to the sidewall of the pole. The upper end of helical spring 107 engages hook 111 which in turn is integrally formed with the threaded cylinder 112 which is provided with an adjusting slot 113 that permits tension on the spring 107 to be adjusted. If desired, an opening 114 in the cover or grip 102 may be provided to permit access to the slot 113 without removal of the grip.

In operation of the embodiment illustrated in FIG. 3 tension is applied to the spring 107 by adjusting the position of the threaded member 112 so that a selected desired force is required to move the handle section 101 angular to the lower section on the application of forces exceeded in preselected minimum at an angle to the length of the ski pole. When, for example, the tip of the pole is imbedded in the snow the grip portion 102 will bend angularly with respect to the lower portion at the junction of flange 104 and angular lip 103. When the force is reduced the tension of spring 107 tends to return the grip and lower section of the pole to their original longitudinal alignment.

Figure 5:
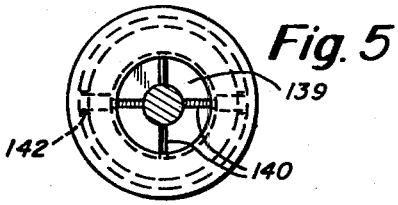
FIG. 5 is a cross-sectional view of an embodiment shown in FIG. 4 taken substantially along the line 5—5 of FIG. 4.
Figure 4:
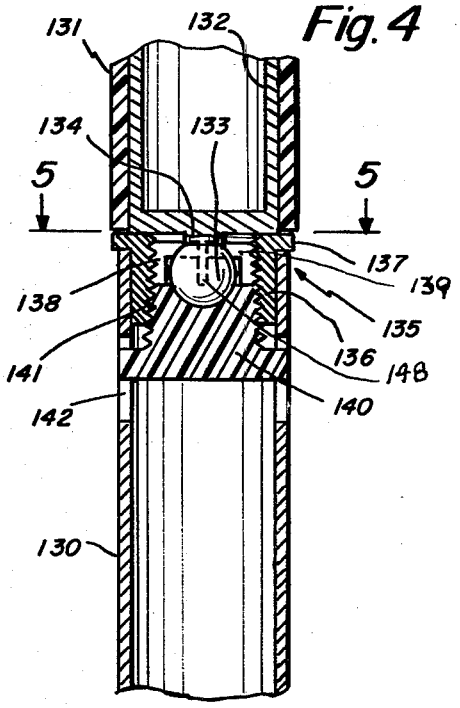
FIG. 4 is a fragmentary longitudinal cross-sectional view of a still another modification of my invention.

The modification illustrated in FIGS. 4 and 5 includes a lower section of a ski pole 130 aligned with an upper section or handle 131. These sections are tubular. An inner sleeve 132 in the grip section 131 is formed with a downwardly projecting ball 133 connected to the bottom of the sleeve 132 by a narrow neck 134. The ball 133 projects downwardly into the lower section 130 and is secured in this section by the assembly generally illustrated at 135. This assembly includes a sleeve 136 having an outwardly extending flange 137 at its upper end that rests on the upper edge of section 130. This sleeve is internally threaded and receives the retainer 138. The retainer 138 is externally threaded and is provided with an inwardly extending flange 139 that defines a central opening through which the neck 134 extends. The inwardly extending flange 139 has multiple radial slots 148 that permit this flange to flex. The opening formed by the flange 139 is sufficient, when the flange is distended under appropriate pressure, to permit the ball to pop out of engagement with the retaining element 135. An adjustable stop 140 is positioned below the ball with its upper end adapted to engage it. The stop 140 is formed with a threaded section 141 that engages the internal thread of sleeve 136. Slots 142 in the lower section 130 permit manual rotation of stop 140. This manual rotation of stop 140 will allow stop 140 to be moved upwardly forcing the ball 133 partially through the flange 139. Thus by adjusting the pressure on the ball 133, the ball 133 may be partially projected through the flange 133 thus reducing the amount of tension required to pop the ball through and release the upper section or grip section 131 from the lower section 130.

What is claimed is:

1. A ski pole adapted to fold on application of a force of a predetermined minimum magnitude in a direction angular to its length, said pole comprising an upper tubular section and a separate lower tubular section, means for securing said sections in longitudinal alignment against forces angular to the length of said pole and below a preselected magnitude and for allowing said upper section to be moved to a position angular to the length of said lower section in response to forces above said preselected minimum magnitude in directions at an angle to the length of said pole, said means for securing comprising a flexible member having one end extending into said upper tubular section and the other end extending into said lower tubular section and further having a connector section secured in one of said upper and lower tubular sections and extending into the other thereof, said connector section securing said upper and lower tubular sections together when said upper and lower sections are folded in response to the applications of a force in excess of said preselected minimum, said means for securing further including a cylindrical end secured in said upper tubular section and integral with said connector section, a sleeve secured in said lower tubular section and having a hole through which said connector section extends, and means extending through said sleeve for engaging said connector section.

2. A ski pole as set forth in claim 1 wherein said means extending through said sleeve comprises a spring loaded detent engaging a recess in said connector section.

3. A ski pole as set forth in claim 2 including means for adjusting the force applied by said spring or said detent.

* * * * *